United States Patent [19]

Asari et al.

[11] Patent Number: 4,637,112

[45] Date of Patent: Jan. 20, 1987

[54] METHOD FOR SHAPING ALUMINUM WHEEL

[75] Inventors: Akira Asari, Hyogo; Satoshi Matsumoto, Osaka; Shigeo Hattori, Kobe; Takayoshi Dosai, Hyogo, all of Japan

[73] Assignee: Kabushiki Kaisha Kobe Seiko Sho, Kobe, Japan

[21] Appl. No.: 822,807

[22] Filed: Jan. 27, 1986

[30] Foreign Application Priority Data

Mar. 19, 1985 [JP] Japan ..... 60-56348

[51] Int. Cl.[4] ..... B21K 1/32

[52] U.S. Cl. ..... 29/159.01; 148/11.5 A

[58] Field of Search ..... 29/159.01, 159.1, 159 R; 148/11.5 A, 12.7 A; 301/63 R, 62, 96

[56] References Cited

U.S. PATENT DOCUMENTS 2,736,674 2/1956 Harmon ..... 148/12.7 A
3,757,413 9/1973 Craik ..... 29/159.1
4,528,734 7/1985 Beyer ..... 29/159.01

FOREIGN PATENT DOCUMENTS 112139 8/1980 Japan ..... 29/159.01

*Primary Examiner*—Howard N. Goldberg
*Assistant Examiner*—P. W. Echols
*Attorney, Agent, or Firm*—Oblon, Fisher, Spivak, McClelland, & Maier

[57] ABSTRACT

Described herein is a method for shaping aluminum wheels, which comprises the steps of: (A) supporting opposite rim portions of a cylindrical forging aluminum work substantially of H-shape in section by means of spinning dies, and subjecting the work to primary spinning including press-shaping by a work-stretching first spinning roller and preliminary spinning by a second spinning roller; (B) flaring the inner end of the rim; (C) annealing the work to remove the work-hardening resulting from the flaring operation; and (D) subjecting the work to secondary spinning including final spinning by the second spinning roller and corner R-finishing by a third spinning roller.

1 Claim, 2 Drawing Figures

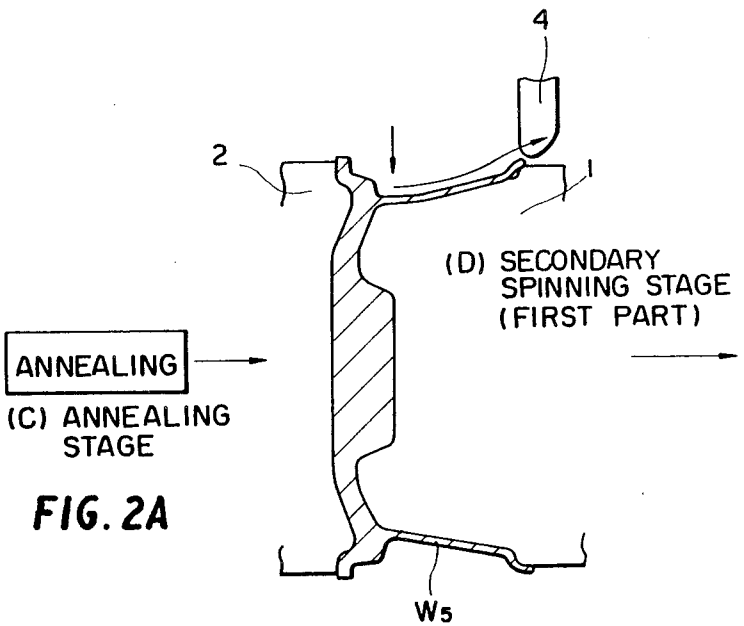
FIG. 2A
FIG. 2B
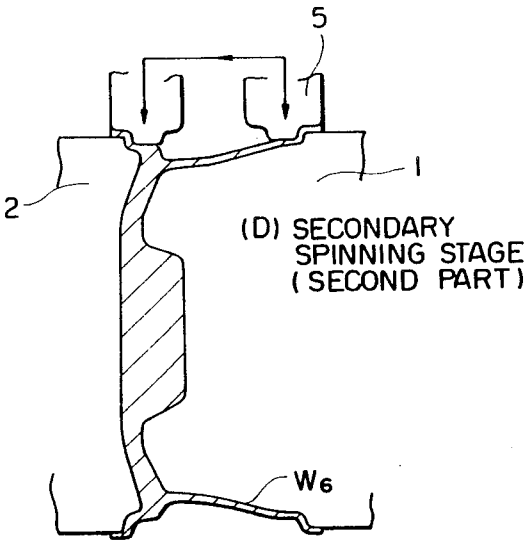
FIG. 2C

METHOD FOR SHAPING ALUMINUM WHEEL

BACKGROUND OF THE INVENTION

1. Field of the Invention

This invention relates to a method for shaping aluminum wheels by the use of simple forging blanks.

2. Discussion of the Background

Heretofore, integral type aluminum wheels have generally been shaped either (1) by splitting apart the circumference of a blank after machining, and spinning it to shape, or (2) by spinning to shape a blank after forging the same to a shape suitable for a spinning operation. In any case, the process required machining prior to spinning or forging dies of complicated shapes, necessarily incurring large expenses for the preparatory machining operation or for the dies.

SUMMARY OF THE INVENTION

The present invention aims at the elimination of the above-mentioned problems or drawbacks, and has as its object the provision of a method for shaping aluminum wheels by spinning by the use of simple forging material or blanks and without necessitating dies of complicate shape.

In accordance with the present invention, there is provided an aluminum wheel shaping method which comprises the steps of:

(A) supporting opposite rim portions of a cylindrical forging aluminum work W1 substantially of H-shape in section by spinning dies, and subjecting the work to primary spinning including press-shaping by a work-stretching first spinning roller and preliminary spinning by a second spinning roller;

(B) flaring the inner end of the rim;

(C) annealing the work to remove the work-hardening resulting from the flaring operation; and (D) subjecting the work to secondary spinning including final spinning by the second spinning roller and corner R-finishing by a third spinning roller.

The above and other objects, features and advantages of the invention will become apparent from the following description and the appended claims, taken in conjunction with the accompanying drawing, which show by way of example a preferred embodiment of the invention.

BRIEF DESCRIPTION OF THE DRAWING

In the accompanying drawing:

FIGS. 1 and 2 are schematic views of the steps for shaping an aluminum wheel according to the method of the present invention.

DESCRIPTION OF PREFERRED EMBODIMENTS

Figures 1A, 1B, 1C, 1D, 1E:
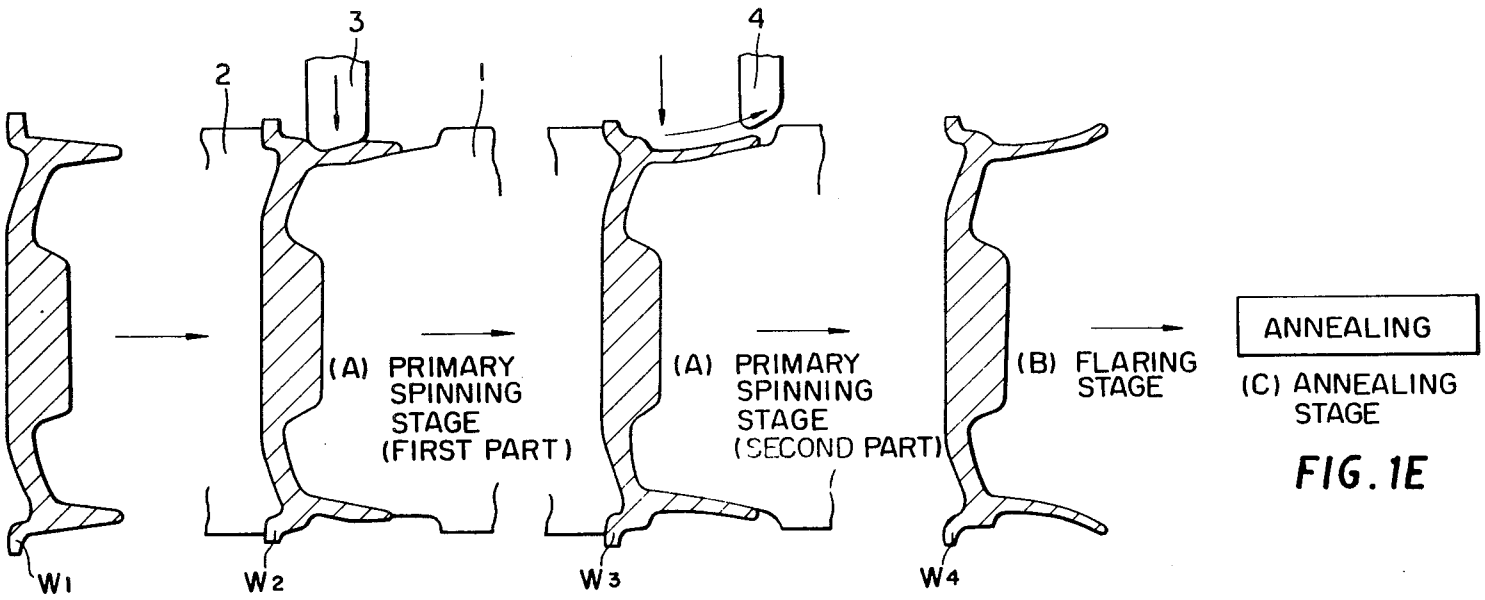

Generally, it is said that the shaping of aluminum wheels by spinning has limitations because of the cracks or other defects which are likely to occur due to the work-hardening in the flaring stage particularly where the spinning operation is effected in excess of a certain extent. Therefore, when shaping aluminum wheels by spinning, it is necessary to remove work-hardening which will cause cracks. In this regard, it has been found that very satisfactory results can be obtained by dividing the spinning operation into two stages for primary and secondary spinning and interposing therebetween a flaring operation and annealing for removal of the work-hardening resulting from the flaring operation.

In the primary spinning stage, it is suitable to carry out the spinning first by a work-stretching first spinning roller for press-shaping a thick-walled work or blank and then by a second spinning roller for preliminary spinning. As shown in FIG. 1, a forging work W1 is supported by spinning dies 1 and 2 at its opposite rim portions, and then worked by a work-stretching first spinning roller 3 to obtain a roughly shaped work W2 (shown on the left side of Step (A)). Next, inner rim portions of the work W2 are preliminarily spun along the spinning die 2 by a second spinning roller 4 to obtain an intermediate shaped work W3 (shown on the right side of Step (A)). In this instance, even a thick-walled blank can be roughly shaped by increasing the extent of the primary spinning.

Subsequent to the above-described primary spinning stage, the inner end of the rim of the intermediate shaped work W3 is flared (see step (B)). In this stage, work-hardening occurs to the resulting secondary intermediate shaped work W4, but it is removed by an annealing treatment in the following stage (see Stage (C)).

The annealed intermediate shaped work W4 is then subjected to secondary spinning, preferably effecting corner R-finishing after a final spinning operation. More particularly, as shown in FIG. 2, the secondary intermediate shaped work W4 is supported by the spinning dies 1 and 2 at the opposite rim portions, and finally spun by the second spinning roller 4 to obtain a tertiary intermediate shaped work W5 (shown on the left side in Step (D)). Next, the corner R portion is finished by a third spinning roller 5 along the spinning dies 1 and 2 to obtain a finished product W6 (see Step (D)). By so doing, the finish spinning can be effected without cracks or wrinkles in the secondary spinning stage.

It will be appreciated from the foregoing description that, according to the present invention, aluminum wheels free of defects can be shaped from simple forging blanks without the need for a machining operation before spinning or forging dies of complicate shapes. Accordingly, the invention contributes to enhanced productivity to a considerable degree and to the reduction of the production cost of aluminum wheels.

What is claimed is:

1. A method for forming aluminum wheels from cylindrical forging aluminum blanks of substantially H-shape in section, comprising the steps of:

(A)

i supporting opposite rim portions of an aluminum work by spinning dies, and ii subjecting said work to primary spinning including press-shaping by a thick-walled-work-stretching first spinning roller and iii subjecting said work to preliminary spinning by a second spinning roller;

(B) flaring the inner end of said rim;

(C) annealing said work to remove work-hardening resulting from the flaring operation; and (D) subjecting said work to secondary spinning including final spinning by said second spinning roller and corner R-finishing by a third spinning roller.

* * * * *